US007423211B2

(12) United States Patent
Hsieh

(10) Patent No.: US 7,423,211 B2
(45) Date of Patent: Sep. 9, 2008

(54) HOLDING DEVICE WITH TWO COMPOSITE WASHER ASSEMBLIES FOR A CYMBAL

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 234 days.

(21) Appl. No.: 11/244,587

(22) Filed: Oct. 6, 2005

(65) Prior Publication Data

US 2007/0079687 A1 Apr. 12, 2007

(51) Int. Cl.
*G10D 13/02* (2006.01)

(52) U.S. Cl. ..... 84/421; 248/443

(58) Field of Classification Search ..... 84/421, 84/422.1, 327; 277/500; 211/85.6; 248/443, 248/447, 447.2
See application file for complete search history.

(56) References Cited

U.S. PATENT DOCUMENTS 2,003,934 A * 6/1935 Hansel ..... 277/500
2,652,361 A * 9/1953 Woods et al. ..... 508/136
5,969,281 A * 10/1999 Suenaga ..... 84/421
6,940,006 B2 * 9/2005 Takegawa ..... 84/327
7,005,568 B2 * 2/2006 Hsieh ..... 84/422.1
7,204,375 B2 * 4/2007 Paiste et al. ..... 211/85.6

* cited by examiner

*Primary Examiner*—Lincoln Donovan
*Assistant Examiner*—Jianchun Qin
(74) *Attorney, Agent, or Firm*—Alan Kamrath; Kamrath & Associates PA

(57) ABSTRACT

A holding device with composite washer assemblies for a cymbal has a stand rod, an adjusting rod, an inner fastener, an outer fastener, an inner composite washer assembly and an outer composite washer assembly. The adjusting rod is mounted pivotally on the stand rod. The inner and outer fasteners are mounted securely on the adjusting rod. The inner and outer composite washer assemblies are mounted around the adjusting rod and are mounted between the inner and outer fasteners. The cymbal is mounted around the adjusting rod and is clamped between the inner and outer composite washer assemblies. Each composite washer assembly has a rubber washer, a felt washer and a silica gel washer to provide a moderate sound.

20 Claims, 8 Drawing Sheets

HOLDING DEVICE WITH TWO COMPOSITE WASHER ASSEMBLIES FOR A CYMBAL

BACKGROUND OF THE INVENTION

1. Field of the Invention

The present invention relates to a holding device for a cymbal and especially to a holding device with two composite washer assemblies for a cymbal.

2. Description of the Prior Arts

Cymbals are part of jazz drums. The cymbals are held on holding devices to hold the cymbals at a certain height that is easy for the user to drum. The conventional holding device comprises a stand rod, an adjusting rod, two washers and two fasteners. The adjusting rod is mounted pivotally on the stand rod. The cymbal is mounted around the adjusting rod. The washers are mounted around the adjusting rod and are adjacent respectively to the two sides of the cymbal. The fasteners are mounted on the adjusting rod. The washers and the cymbal are clamped between the two fasteners. The washers are used to absorb shocks when the cymbal is drummed. Because the shock-absorbing effects provided by washers made of different materials are different, sounds given off by a cymbal with different washers are different. Conventional washers are always made of felt or rubber. The shock-absorbing effect of washers made of felt is relatively small so that the sound given off by the cymbal is mellow and lasts longer. The shock-absorbing effect of washers made of rubber is relatively large so that the sound given off by the cymbal is shrill sound and lasts shorter. Therefore, different washers are necessary to fit with needs of different drummers having different performing habits or for performing different styles of music.

In addition, because the aforementioned two different conventional washers provide two extreme sounds, the drummer has to change the washers to fit with different styles of music. Furthermore, most music does not need such an extreme sound. Therefore, using either kind of conventional washers cannot provide a moderate sound to fit with most music.

To overcome the shortcomings, the present invention provides a holding device with two composite washer assemblies for a cymbal to mitigate or obviate the aforementioned problems.

SUMMARY OF THE INVENTION

The main objective of the present invention is to provide a holding device with composite washer assemblies for a cymbal to give off moderate sound. The holding device with composite washer assemblies for a cymbal has a stand rod, an adjusting rod, an inner fastener, an outer fastener, an inner composite washer assembly and an outer composite washer assembly. The adjusting rod is mounted pivotally on the stand rod. The inner and outer fasteners are mounted securely on the adjusting rod. The inner and outer composite washer assemblies are mounted around the adjusting rod and are mounted between the inner and outer fasteners. The cymbal is mounted around the adjusting rod and is clamped between the inner and outer composite washer assemblies. Each composite washer assembly has a rubber washer, a felt washer and a silica gel washer to provide a moderate sound.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
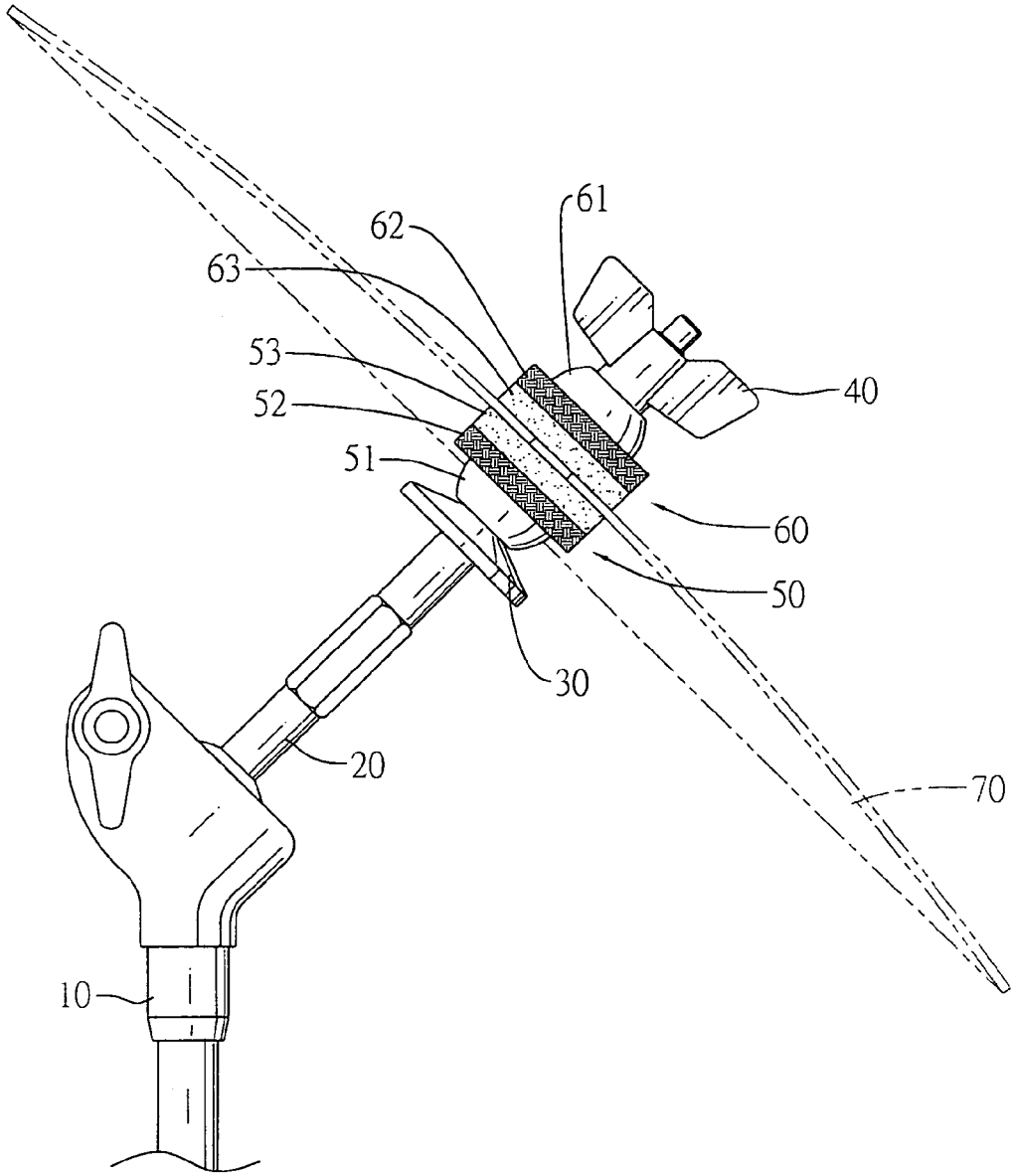
FIG. 1 is a side view of a first embodiment of a holding device with composite washer assemblies for a cymbal in accordance with the present invention with a cymbal.
Figure 2:
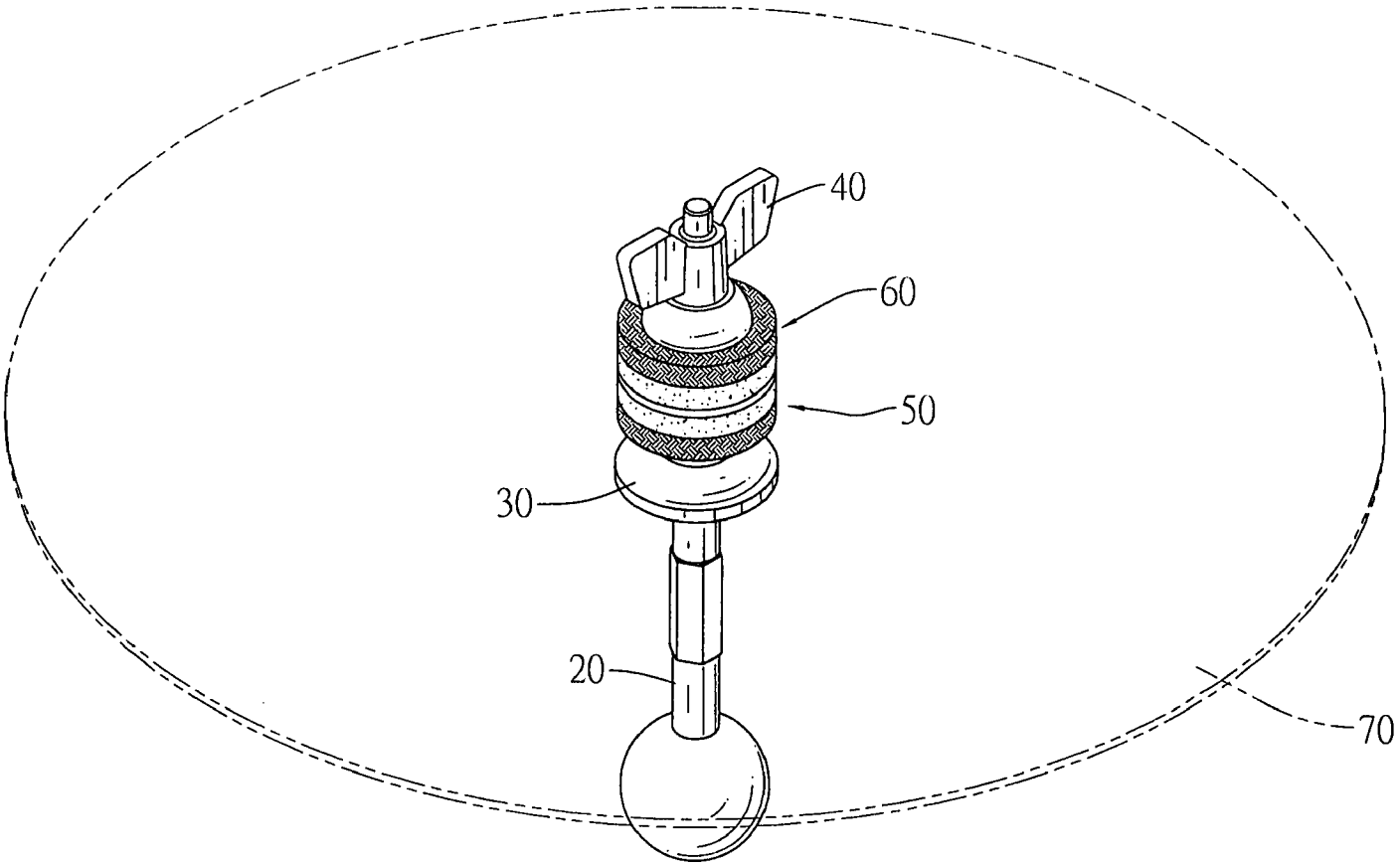
FIG. 2 is a partial perspective view of the holding device in FIG. 1 with the cymbal.
Figure 3:
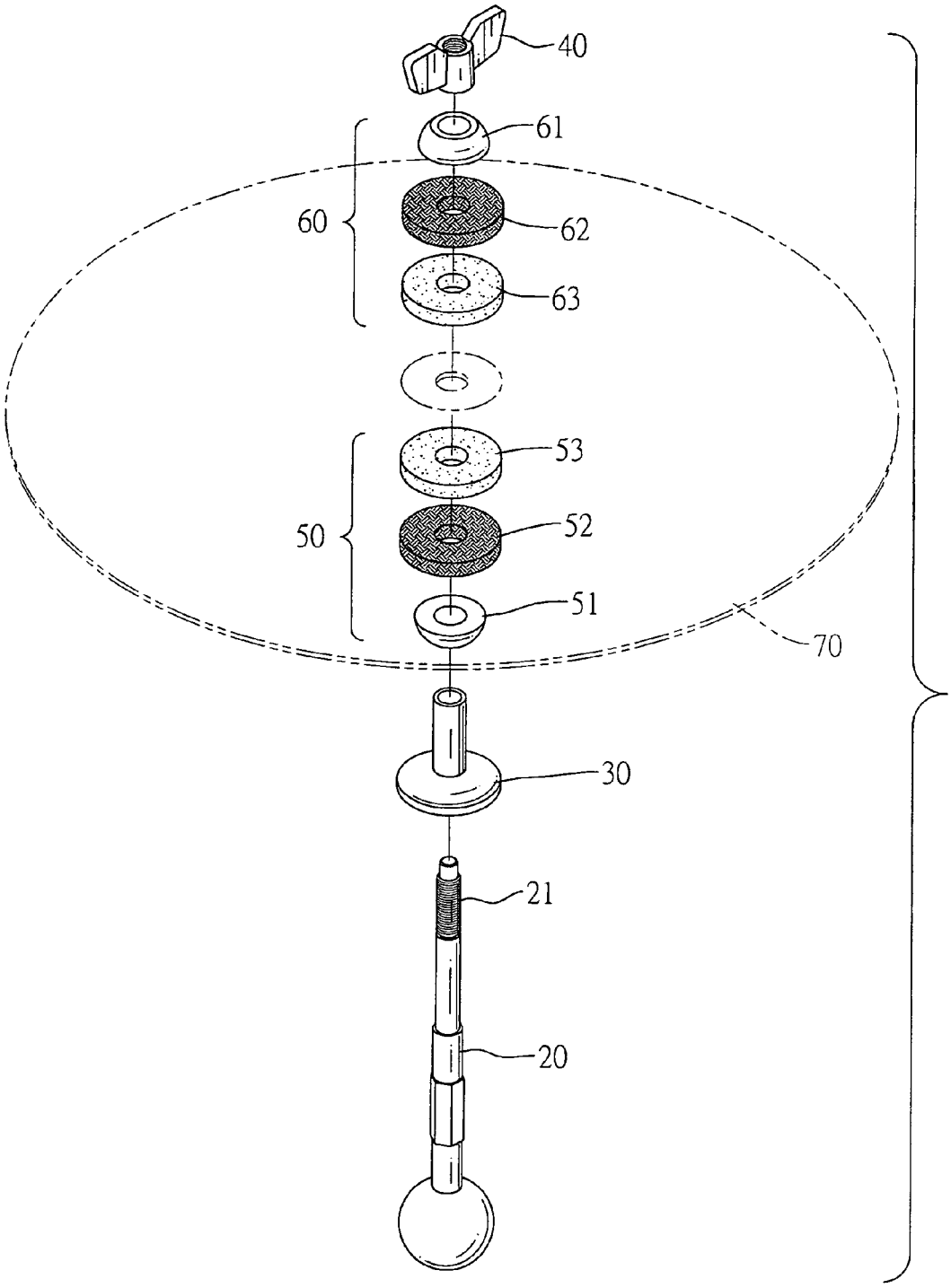
FIG. 3 is a partial exploded perspective view of the holding device in FIG. 1 with the cymbal.

With reference to FIGS. 1-3, a holding device with composite washer assemblies for a cymbal in accordance with the present invention clamps a cymbal (70) and comprises a stand rod (10), an adjusting rod (20), an inner fastener (30), an outer fastener (40), an inner composite washer assembly (50) and an outer composite washer assembly (60).

The adjusting rod (20) is mounted pivotally on the stand rod (10) and has a pivoting end and a threaded end (21). The inner fastener (30) is mounted securely on the adjusting rod (20). The outer fastener (40) is screwed on the threaded end (21) of the adjusting rod (20).

The inner composite washer assembly (50) is mounted around the adjusting rod (20), is mounted between the inner and outer fasteners (30, 40) and is adjacent to the inner fastener (30). The outer composite washer assembly (60) is mounted around the adjusting rod (20), is mounted between the inner and outer fasteners (30, 40) and is adjacent to the outer fastener (40). The cymbal (70) is mounted around the adjusting rod (20) and is clamped by the inner and outer composite washer assemblies (50, 60).

Each composite washer assembly (50, 60) has a rubber washer (51, 61), a felt washer (52, 62) and an optional silica gel washer (53, 63).

The first embodiment of the holding device is shown in FIG. 1. The rubber washer (51) of the inner composite washer assembly (50) is adjacent to the inner fastener (30). The silica gel washer (53) of the inner composite washer assembly (50) is adjacent to the cymbal (70). The felt washer (52) of the inner composite washer assembly (50) is mounted between the rubber and silica gel washers (51, 53) of the inner composite washer assembly (50). The rubber washer (61) of the outer composite washer assembly (60) is adjacent to the outer fastener (40). The silica gel washer (63) of the outer composite washer assembly (60) is adjacent to the cymbal (70). The felt washer (62) of the outer composite washer assembly (60) is mounted between the rubber and silica gel washers (61, 63) of the outer composite washer assembly (60).

Figure 4:
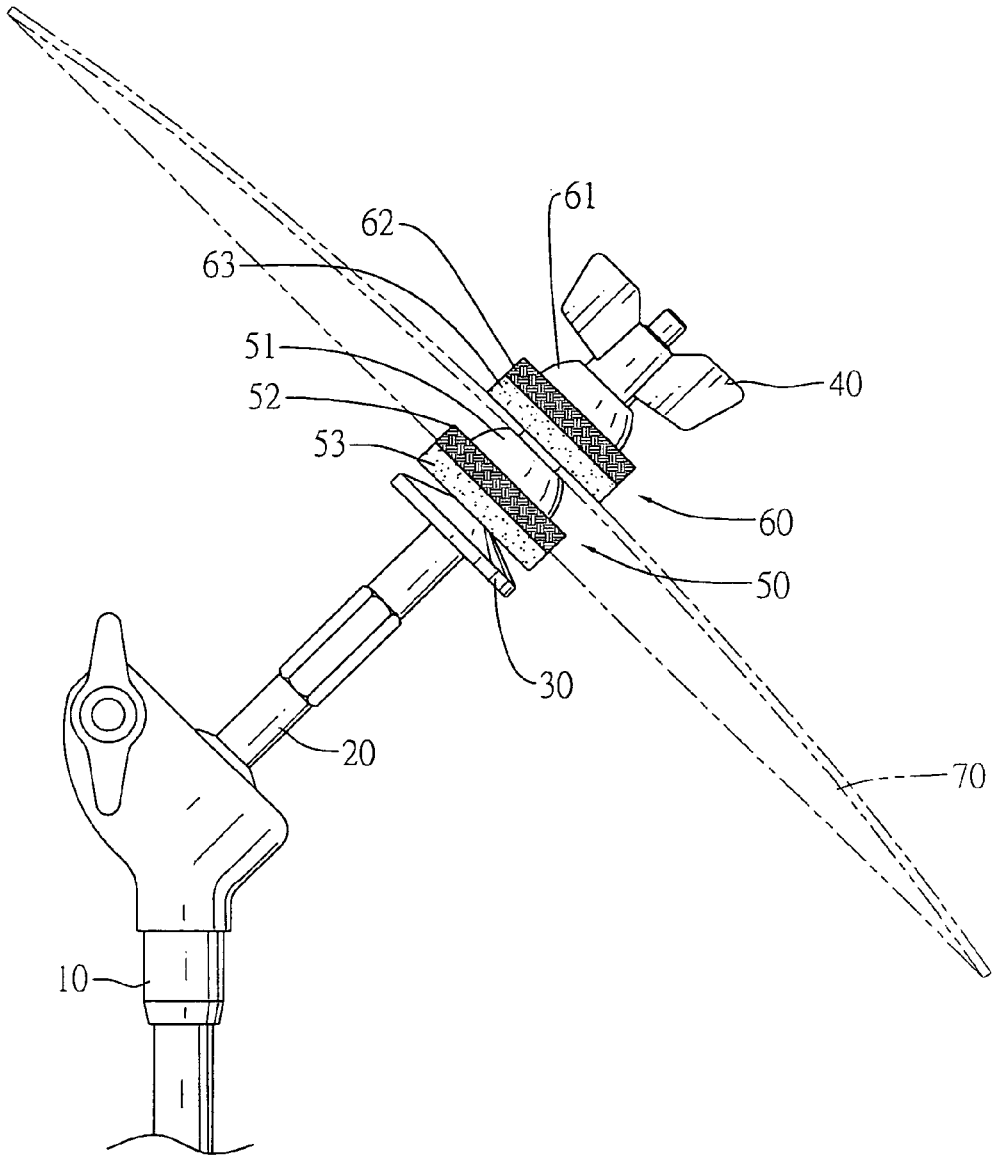
FIG. 4 is a side view of a second embodiment of a holding device with composite washer assemblies for a cymbal in accordance with the present invention with a cymbal.

The second embodiment of the holding device is shown in FIG. 4. The silica gel washer (53) of the inner composite washer assembly (50) is adjacent to the inner fastener (30). The rubber washer (51) of the inner composite washer assembly (50) is adjacent to the cymbal (70). The felt washer (52) of the inner composite washer assembly (50) is mounted between the silica gel and rubber washers (53, 51) of the inner composite washer assembly (50). The rubber washer (61) of the outer composite washer assembly (60) is adjacent to the outer fastener (40). The silica gel washer (63) of the outer composite washer assembly (60) is adjacent to the cymbal (70). The felt washer (62) of the outer composite washer assembly (60) is mounted between the rubber and silica gel washers (61, 63) of the outer composite washer assembly (60).

Figure 5:
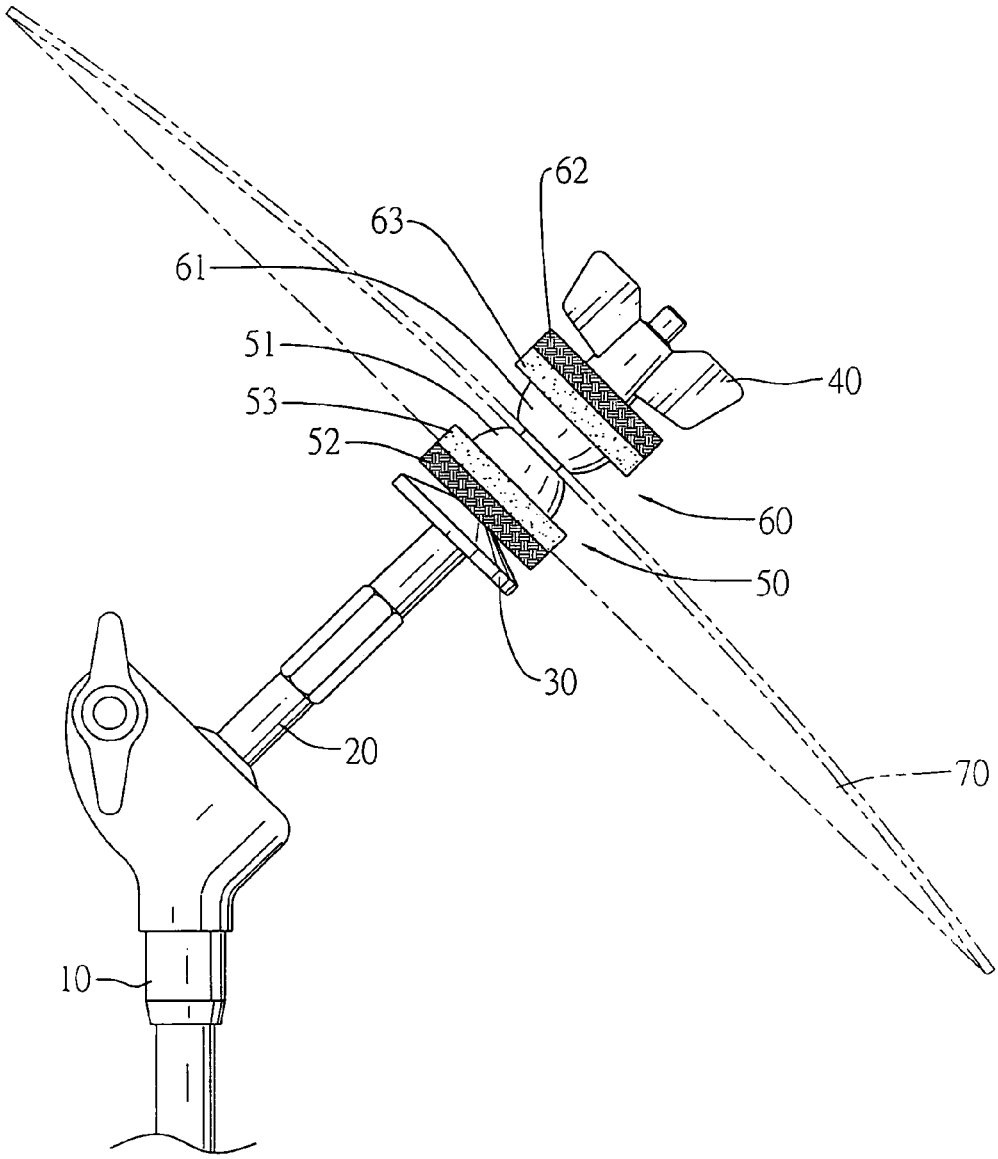
FIG. 5 is a side view of a third embodiment of a holding device with composite washer assemblies for a cymbal in accordance with the present invention with a cymbal.

The third embodiment of the holding device is shown in FIG. 5. The felt washer (52) of the inner composite washer assembly (50) is adjacent to the inner fastener (30). The rubber washer (51) of the inner composite washer assembly (50) is adjacent to the cymbal (70). The silica gel washer (53) of the inner composite washer assembly (50) is mounted between the felt and rubber washers (52, 51) of the inner composite washer assembly (50). The felt washer (62) of the outer composite washer assembly (60) is adjacent to the outer fastener (40). The rubber washer (61) of the outer composite washer assembly (60) is adjacent to the cymbal (70). The silica gel washer (63) of the outer composite washer assembly (60) is mounted between the felt and rubber washers (62, 61) of the outer composite washer assembly (60).

Figure 6:
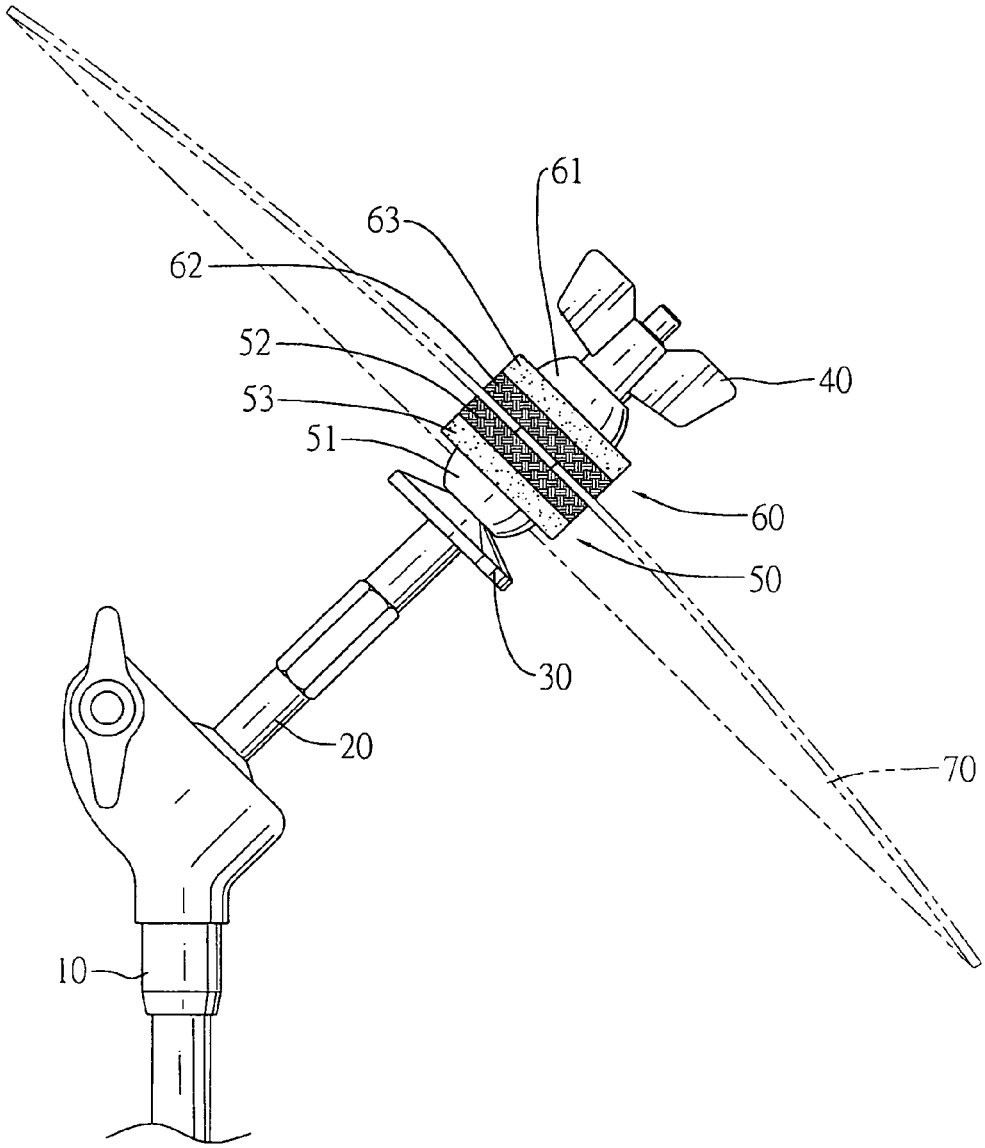
FIG. 6 is a side view of a fourth embodiment of a holding device with composite washer assemblies for a cymbal in accordance with the present invention with a cymbal.

The fourth embodiment of the holding device is shown in FIG. 6. The rubber washer (51) of the inner composite washer assembly (50) is adjacent to the inner fastener (30). The felt washer (52) of the inner composite washer assembly (50) is adjacent to the cymbal (70). The silica gel washer (53) of the inner composite washer assembly (50) is mounted between the rubber and felt washers (51, 52) of the inner composite washer assembly (50). The rubber washer (61) of the outer composite washer assembly (60) is adjacent to the outer fastener (40). The felt washer (62) of the outer composite washer assembly (60) is adjacent to the cymbal (70). The silica gel washer (63) of the outer composite washer assembly (60) is mounted between the rubber and felt washers (61, 62) of the outer composite washer assembly (60).

Figure 7:
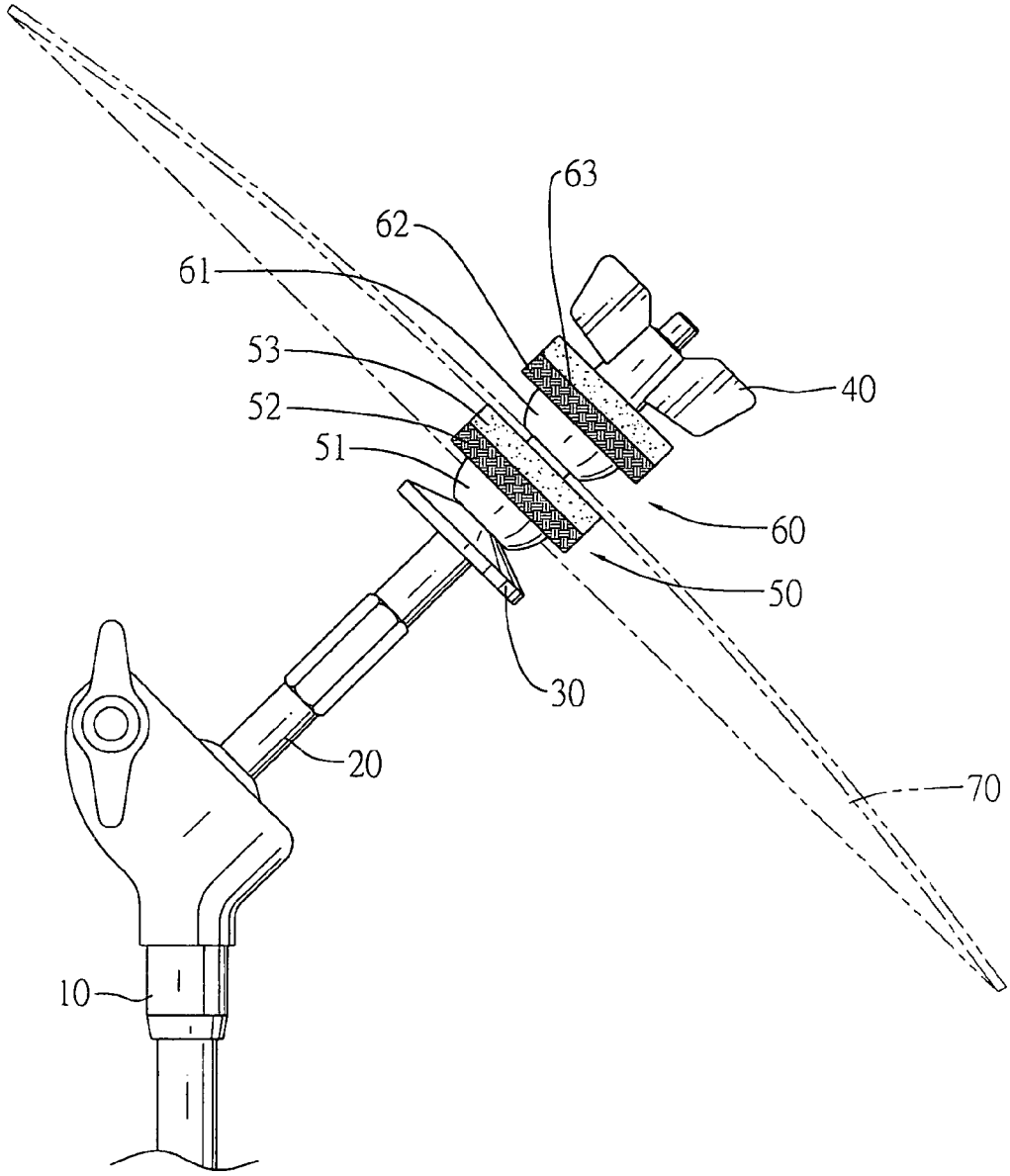
FIG. 7 is a side view of a fifth embodiment of a holding device with composite washer assemblies for a cymbal in accordance with the present invention with a cymbal.

The fifth embodiment of the holding device is shown in FIG. 7. The rubber washer (51) of the inner composite washer assembly (50) is adjacent to the inner fastener (30). The silica gel washer (53) of the inner composite washer assembly (50) is adjacent to the cymbal (70). The felt washer (52) of the inner composite washer assembly (50) is mounted between the rubber and silica gel washers (51, 53) of the inner composite washer assembly (50). The silica gel washer (63) of the outer composite washer assembly (60) is adjacent to the outer fastener (40). The rubber washer (61) of the outer composite washer assembly (60) is adjacent to the cymbal (70). The felt washer (62) of the outer composite washer assembly (60) is mounted between the silica gel and rubber washers (63, 61) of the outer composite washer assembly (60).

Figure 8:
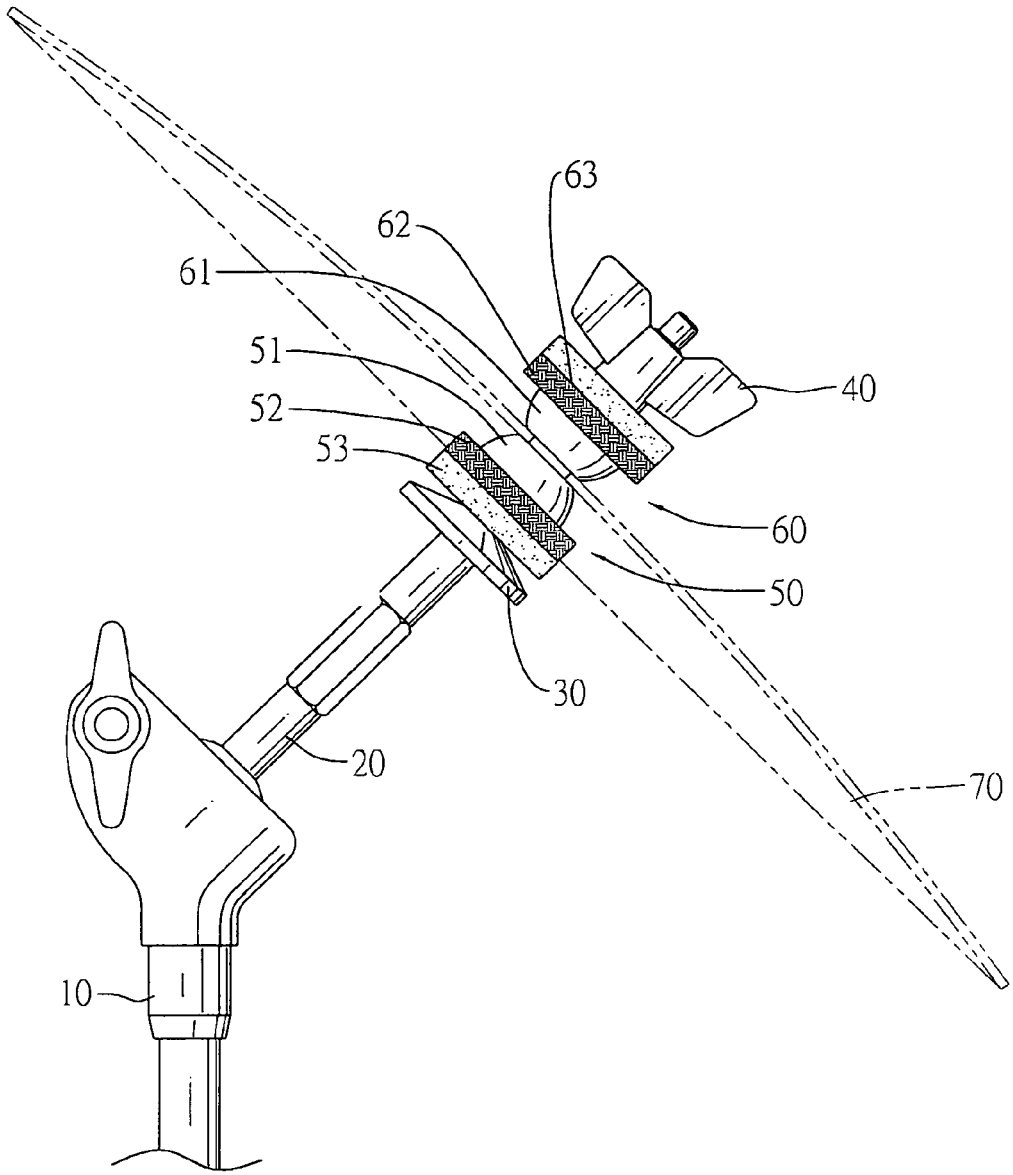
FIG. 8 is a side view of a sixth embodiment of a holding device with composite washer assemblies for a cymbal in accordance with the present invention with a cymbal.

The sixth embodiment of the holding device is shown in FIG. 8. The silica gel washer (53) of the inner composite washer assembly (50) is adjacent to the inner fastener (30). The rubber washer (51) of the inner composite washer assembly (50) is adjacent to the cymbal (70). The felt washer (52) of the inner composite washer assembly (50) is mounted between the silica gel and rubber washers (53, 51) of the inner composite washer assembly (50). The silica gel washer (63) of the outer composite washer assembly (60) is adjacent to the outer fastener (40). The rubber washer (61) of the outer composite washer assembly (60) is adjacent to the cymbal (70). The felt washer (62) of the outer composite washer assembly (60) is mounted between the silica gel and rubber washers (63, 61) of the outer composite washer assembly (60).

The holding device as described has numerous advantages. The composite washer assemblies with washers that are made of different materials provide a moderate sound. Different arrangements of the washers provide different sound performance to increase variations of the performance.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A holding device with composite washer assemblies for a cymbal comprising:

a stand rod;

an adjusting rod mounted pivotally on the stand rod and having a pivoting end and a threaded end;

an inner fastener mounted securely on the adjusting rod;

an outer fastener screwing on the threaded end of the adjusting rod;

an inner composite washer assembly mounted around the adjusting rod, mounted between the inner and outer fasteners, being adjacent to the inner fastener and having a rubber washer and a felt washer; and an outer composite washer assembly mounted around the adjusting rod, mounted between the inner and outer fasteners, being adjacent to the outer fastener and having a rubber washer and a felt washer, wherein each composite washer assembly further comprises a silica gel washer, wherein the rubber washer of the inner composite washer assembly is adjacent to the inner fastener;

the felt washer of the inner composite washer assembly is mounted between the rubber and silica gel washers of the inner composite washer assembly;

the rubber washer of the outer composite washer assembly is adjacent to the outer fastener; and the felt washer of the outer composite washer assembly is mounted between the rubber and silica gel washers of the outer composite washer assembly.

2. The holding device as claimed in claim 1, wherein the rubber washer of the inner composite washer assembly is comprised of rubber, with the rubber directly abutting the felt washer of the inner composite washer assembly.

3. The holding device as claimed in claim 1, wherein the rubber washer of the outer composite washer assembly is comprised of rubber, with the rubber directly abutting the felt washer of the outer composite washer assembly.

4. The holding device as claimed in claim 1, with the outer composite washer assembly separately formed and spaced from the inner composite washer assembly.

5. The holding device as claimed in claim 4, wherein the inner rubber washer is comprised of rubber, with the rubber directly abutting the inner felt washer.

6. A holding device with composite washer assemblies for a cymbal comprising:

a stand rod;

an adjusting rod mounted pivotally on the stand rod and having a pivoting end and a threaded end;

an inner fastener mounted securely on the adjusting rod;

an outer fastener screwing on the threaded end of the adjusting rod;

an inner composite washer assembly mounted around the adjusting rod, mounted between the inner and outer fasteners, being adjacent to the inner fastener and having a rubber washer and a felt washer; and an outer composite washer assembly mounted around the adjusting rod, mounted between the inner and outer fasteners, being adjacent to the outer fastener and having a rubber washer and a felt washer, wherein each composite washer assembly further comprises a silica gel washer, wherein the silica gel washer of the inner composite washer assembly is adjacent to the inner fastener;

the felt washer of the inner composite washer assembly is mounted between the silica gel and rubber washers of the inner composite washer assembly;

the rubber washer of the outer composite washer assembly is adjacent to the outer fastener; and the felt washer of the outer composite washer assembly is mounted between the rubber and silica gel washers of the outer composite washer assembly.

7. The holding device as claimed in claim 6, wherein the rubber washer of the inner composite washer assembly is comprised of rubber, with the rubber directly abutting the felt washer of the inner composite washer assembly.

8. The holding device as claimed in claim 6, wherein the rubber washer of the outer composite washer assembly is comprised of rubber, with the rubber directly abutting the felt washer of the outer composite washer assembly.

9. The holding device as claimed in claim 6, with the outer composite washer assembly separately formed and spaced from the inner composite washer assembly.

10. The holding device as claimed in claim 9, wherein the inner rubber washer is comprised of rubber, with the rubber directly abutting the inner felt washer.

11. A holding device with composite washer assemblies for a cymbal comprising:

a stand rod;

an adjusting rod mounted pivotally on the stand rod and having a pivoting end and a threaded end;

an inner fastener mounted securely on the adjusting rod;

an outer fastener screwing on the threaded end of the adjusting rod;

an inner composite washer assembly mounted around the adjusting rod, mounted between the inner and outer fasteners, being adjacent to the inner fastener and having a rubber washer and a felt washer; and an outer composite washer assembly mounted around the adjusting rod, mounted between the inner and outer fasteners, being adjacent to the outer fastener and having a rubber washer and a felt washer, wherein each composite washer assembly further comprises a silica gel washer, wherein the felt washer of the inner composite washer assembly is adjacent to the inner fastener;

the silica gel washer of the inner composite washer assembly is mounted between the felt and rubber washers of the inner composite washer assembly;

the felt washer of the outer composite washer assembly is adjacent to the outer fastener; and the silica gel washer of the outer composite washer assembly is mounted between the felt and rubber washers of the outer composite washer assembly.

12. The holding device as claimed in claim 11, wherein the rubber washer of the inner composite washer assembly is comprised of rubber, with the rubber directly abutting the felt washer of the inner composite washer assembly.

13. The holding device as claimed in claim 11, wherein the rubber washer of the outer composite washer assembly is comprised of rubber, with the rubber directly abutting the felt washer of the outer composite washer assembly.

14. A holding device with composite washer assemblies for a cymbal comprising:

a stand rod;

an adjusting rod mounted pivotally on the stand rod and having a pivoting end and a threaded end;

an inner fastener mounted securely on the adjusting rod;

an outer fastener screwing on the threaded end of the adjusting rod;

an inner composite washer assembly mounted around the adjusting rod, mounted between the inner and outer fasteners, being adjacent to the inner fastener and having a rubber washer and a felt washer; and an outer composite washer assembly mounted around the adjusting rod, mounted between the inner and outer fasteners, being adjacent to the outer fastener and having a rubber washer and a felt washer, wherein each composite washer assembly further comprises a silica gel washer, wherein the rubber washer of the inner composite washer assembly is adjacent to the inner fastener;

the silica gel washer of the inner composite washer assembly is mounted between the rubber and felt washers of the inner composite washer assembly;

the rubber washer of the outer composite washer assembly is adjacent to the outer fastener; and the silica gel washer of the outer composite washer assembly is mounted between the rubber and felt washers of the outer composite washer assembly.

15. A holding device with composite washer assemblies for a cymbal comprising:

a stand rod;

an adjusting rod mounted pivotally on the stand rod and having a pivoting end and a threaded end;

an inner fastener mounted securely on the adjusting rod;

an outer fastener screwing on the threaded end of the adjusting rod;

an inner composite washer assembly mounted around the adjusting rod, mounted between the inner and outer fasteners, being adjacent to the inner fastener and having a rubber washer and a felt washer; and an outer composite washer assembly mounted around the adjusting rod, mounted between the inner and outer fasteners, being adjacent to the outer fastener and having a rubber washer and a felt washer, wherein each composite washer assembly further comprises a silica gel washer, wherein the rubber washer of the inner composite washer assembly is adjacent to the inner fastener;

the felt washer of the inner composite washer assembly is mounted between the rubber and silica gel washers of the inner composite washer assembly;

the silica gel washer of the outer composite washer assembly is adjacent to the outer fastener; and the felt washer of the outer composite washer assembly is mounted between the silica gel and rubber washers of the outer composite washer assembly.

16. A holding device with composite washer assemblies for a cymbal comprising:

a stand rod;

an adjusting rod mounted pivotally on the stand rod and having a pivoting end and a threaded end;

an inner fastener mounted securely on the adjusting rod;

an outer fastener screwing on the threaded end of the adjusting rod;

an inner composite washer assembly mounted around the adjusting rod, mounted between the inner and outer fasteners, being adjacent to the inner fastener and having a rubber washer and a felt washer; and an outer composite washer assembly mounted around the adjusting rod, mounted between the inner and outer fasteners, being adjacent to the outer fastener and having a rubber washer and a felt washer, wherein each composite washer assembly further comprises a silica gel washer, wherein the silica gel washer of the inner composite washer assembly is adjacent to the inner fastener;

the felt washer of the inner composite washer assembly is mounted between the silica gel and rubber washers of the inner composite washer assembly;

the silica gel washer of the outer composite washer assembly is adjacent to the outer fastener; and the felt washer of the outer composite washer assembly is mounted between the silica gel and rubber washers of the outer composite washer assembly.

17. The holding device as claimed in claim 16, wherein the rubber washer of the inner composite washer assembly is comprised of rubber, with the rubber directly abutting the felt washer of the inner composite washer assembly.

18. The holding device as claimed in claim 16, wherein the rubber washer of the outer composite washer assembly is comprised of rubber, with the rubber directly abutting the felt washer of the outer composite washer assembly.

19. The holding device as claimed in claim 16, with the outer composite washer assembly separately formed and spaced from the inner composite washer assembly.

20. The holding device as claimed in claim 19, wherein the inner rubber washer is comprised of rubber, with the rubber directly abutting the inner felt washer.

* * * * *